US010674822B1

(12) United States Patent
Koyama

(10) Patent No.: US 10,674,822 B1
(45) Date of Patent: Jun. 9, 2020

(54) HARNESS CONNECTION STRUCTURE AND ELECTRONIC DEVICE

(71) Applicant: FUJI XEROX CO., LTD., Tokyo (JP)

(72) Inventor: Takaharu Koyama, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/503,644

(22) Filed: Jul. 5, 2019

(30) Foreign Application Priority Data

Mar. 18, 2019 (JP) ..... 2019-049727

(51) Int. Cl.

| | |
|---|---|
| ***G03G 15/00*** | (2006.01) |
| ***A47B 88/90*** | (2017.01) |
| ***A47B 88/467*** | (2017.01) |
| ***B65H 1/26*** | (2006.01) |
| ***A47B 88/447*** | (2017.01) |
| ***A47B 88/45*** | (2017.01) |
| ***A47B 88/443*** | (2017.01) |

(52) U.S. Cl.
CPC ..... *A47B 88/941* (2017.01); *A47B 88/443* (2017.01); *A47B 88/447* (2017.01); *A47B 88/45* (2017.01); *A47B 88/467* (2017.01); *B65H 1/266* (2013.01)

(58) Field of Classification Search
USPC ..... 399/90
See application file for complete search history.

(56) References Cited

U.S. PATENT DOCUMENTS

| | | | | |
|---|---|---|---|---|
| 3,710,199 | A * | 1/1973 | Cignoni, Jr. | H05K 7/1491 361/827 |
| 6,305,556 | B1 * | 10/2001 | Mayer | G06F 1/18 211/175 |
| 6,730,850 | B2 * | 5/2004 | Tsutsumi | H02G 11/00 174/111 |
| 7,082,720 | B2 * | 8/2006 | Kobayashi | B60R 16/0215 49/360 |
| 7,189,924 | B1 * | 3/2007 | Popescu | H05K 7/1491 174/69 |

(Continued)

FOREIGN PATENT DOCUMENTS

| | | |
|---|---|---|
| JP | H06215239 | 8/1994 |
| JP | H11268567 | 10/1999 |
| JP | 2000358319 | 12/2000 |

*Primary Examiner* — Rodney E Fuller
(74) *Attorney, Agent, or Firm* — JCIPRNET

(57) ABSTRACT

A harness connection structure electrically connects a main body and a movable member with a harness to each other. The movable member is provided such that the movable member can be pulled out with respect to the main body. The harness connection structure includes a harness having one end fixed to a front side of one surface of the main body in a pull-out direction of the movable member, the one surface of the main body facing one surface of the movable member with a gap, and the other end fixed to a back side of the movable member in a pull-out direction of the movable member, a first suppressing portion provided on the one surface of the main body and suppressing a movement of the harness to a pull-out side of the movable member, and a second suppressing portion suppressing a movement of the harness toward the movable member between the one surface of the movable member and the one surface of the main body.

20 Claims, 11 Drawing Sheets

(56) References Cited

U.S. PATENT DOCUMENTS

| | | | | |
|---|---|---|---|---|
| 7,472,795 | B2 * | 1/2009 | Dubon | H02G 3/128 211/26 |
| 8,291,816 | B2 * | 10/2012 | Iwamoto | F24C 15/162 219/391 |
| 9,736,959 | B2 * | 8/2017 | Harvilchuck | H05K 7/1491 |
| 9,949,400 | B2 * | 4/2018 | Yi | H05K 7/1491 |
| 10,292,301 | B1 * | 5/2019 | Chen | H05K 7/1491 |
| 2011/0050065 | A1 * | 3/2011 | Lee | E05B 17/0033 312/402 |
| 2013/0341471 | A1 * | 12/2013 | Yang | H05K 7/1491 248/70 |
| 2014/0169828 | A1 * | 6/2014 | Ohta | G03G 15/6502 399/110 |
| 2014/0183306 | A1 * | 7/2014 | Chen | H05K 7/1491 248/70 |

* cited by examiner

HARNESS CONNECTION STRUCTURE AND ELECTRONIC DEVICE

CROSS-REFERENCE TO RELATED APPLICATIONS

This application is based on and claims priority under 35 USC 119 from Japanese Patent Application No. 2019-049727 filed Mar. 18, 2019.

BACKGROUND

(i) Technical Field

The present invention relates to a harness connection structure and an electronic device.

(ii) Related Art

Known is a harness connection structure used for harness-based connection between an apparatus main body and a drawer member disposed such that the drawer member can be pulled out and stored with respect to the apparatus main body (JP2000-358319A). The harness connection structure is provided with a holding member that can be bent or curved with respect to the storage direction of the drawer member with both end portions attached on the apparatus main body side and the drawer member side, respectively. A harness is held along the holding member.

Also known is a vehicular accessory structure having a fixing member provided on a vehicle body side, a drawer member supported by the fixing member so as to be freely pulled out, and electric equipment provided in the drawer member (JP1999-268567A (Alias: JP H11-268567A)). A harness derived from the vehicle body side is connected to the electric equipment, a first guide groove portion extending in a substantially diagonal direction is formed in one of the fixing and drawer members, and a second guide groove portion extending in a direction substantially orthogonal to the direction in which the drawer member is pulled out is formed in the other. A moving member is slidably supported on and along the intersection of the first and second guide groove portions and the harness is wound around the moving member.

SUMMARY

Aspects of non-limiting embodiments of the present disclosure relate to a harness connection structure and an electronic device capable of ensuring electrical connection of a movable member harness-connected to a main body so as to be capable of being pulled out and preventing damage to a harness resulting from storage and pulling out.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a harness connection structure electrically connects a main body and a movable member with a harness to each other, the movable member being provided such that the movable member can be pulled out with respect to the main body, and the harness connection structure includes a harness having one end fixed to a front side of one surface of the main body in a pull-out direction of the movable member, the one surface of the main body facing one surface of the movable member with a gap, and the other end fixed to a back side of the movable member in a pull-out direction of the movable member, a first suppressing portion provided on the one surface of the main body and suppressing a movement of the harness to a pull-out side of the movable member, and a second suppressing portion suppressing a movement of the harness toward the movable member between the one surface of the movable member and the one surface of the main body.

BRIEF DESCRIPTION OF THE DRAWINGS

Exemplary embodiment(s) of the present invention will be described in detail based on the following figures, wherein.

DETAILED DESCRIPTION

Next, the present invention will be described in more detail by way of an exemplary embodiment and specific examples and with reference to accompanying drawings. The present invention is not limited to the exemplary embodiment and the specific examples.

It should be noted that the drawings are schematic and the ratios of respective dimensions and the like are different from actual ratios in the description using the following drawings. Illustration of those other than members necessary for the description is appropriately omitted for ease of understanding.

(1) Overall Configuration and Operation of Image Forming Apparatus

Figure 1:
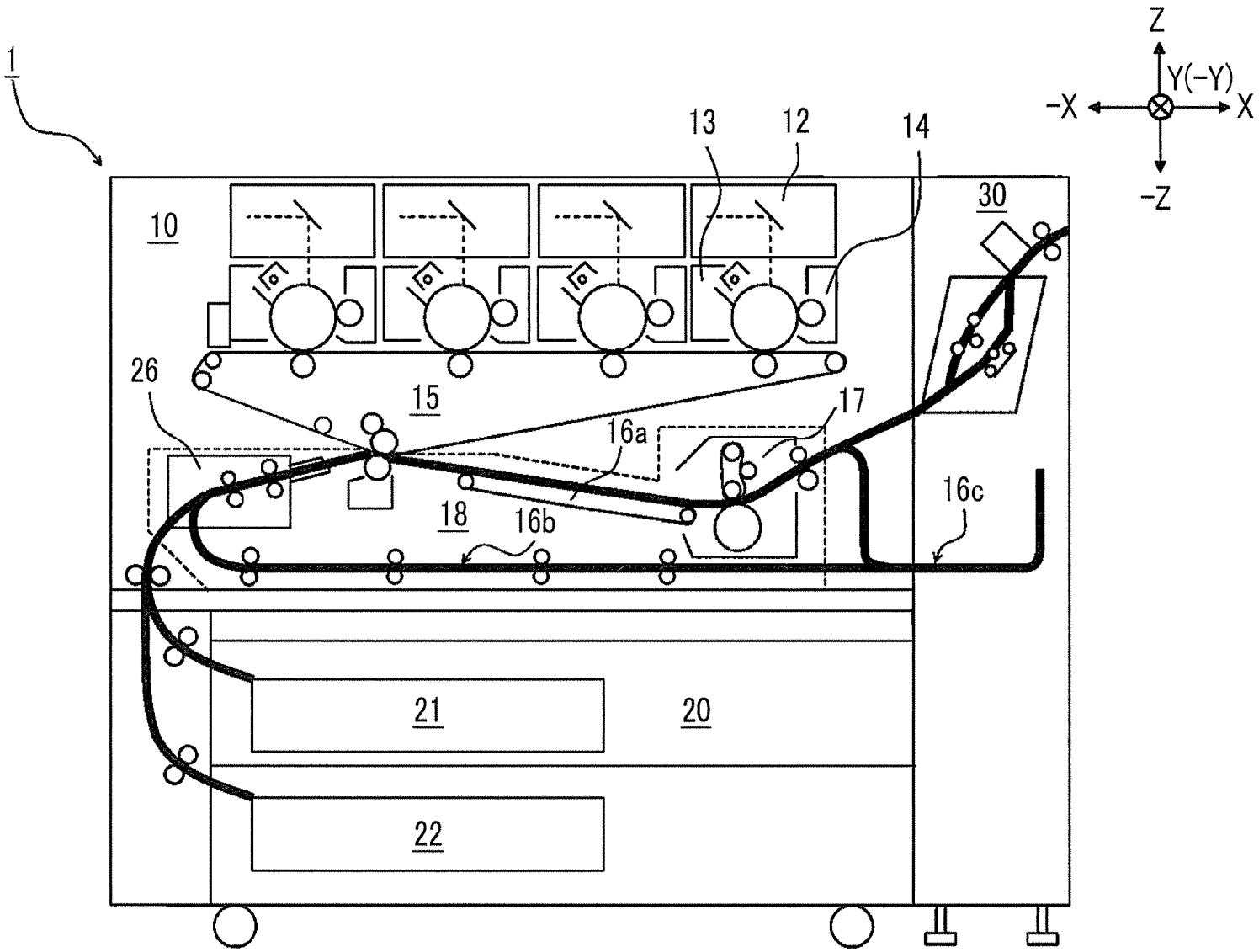
FIG. 1 is a schematic cross-sectional view illustrating an example of a schematic configuration of an image forming apparatus.

FIG. 1 is a schematic cross-sectional view illustrating an example of a schematic configuration of an image forming apparatus 1 according to the present exemplary embodiment.

The image forming apparatus 1 as an example of an electronic device is configured to be provided with an image forming unit 10, a sheet feeding device 20 mounted below the image forming unit 10, a paper discharge unit 30 provided at one end of the image forming unit 10 and discharging printed paper, and an image processing unit 40 (not illustrated) generating image information from printing information transmitted from a higher device.

The image forming unit 10 is configured to be provided with an exposure device 12, a photoreceptor unit 13, a developing device 14, a transfer device 15, a paper transport device 16*a*, and a fixing device 17. The image forming unit forms the image information received from the image processing unit 40 as a toner image on paper P sent from the sheet feeding device 20.

The sheet feeding device 20 having paper trays 21 and 22 is provided in the bottom portion of the image forming unit 10 and performs paper supply to the image forming unit 10.

In other words, paper loading units accommodating the paper P of different types (such as different materials, thicknesses, paper sizes, and paper grains) are provided and the paper P fed from any of the paper loading units is supplied to the image forming unit 10.

The paper trays 21 and 22 can be pulled out to an operator side (in the −Y direction) and replenishment with the paper P is performed with the paper trays 21 and 22 pulled out to the operator side.

The paper discharge unit 30 discharges the paper P with image output performed on the paper P by the image forming unit 10.

To that end, the paper discharge unit 30 is provided with a paper discharge accommodating portion (not illustrated) allowing the paper P to be discharged after the image output.

Also provided is a paper transport device 16*c*, which turns the paper P inside out and sends out the paper P to a paper transport device 16*b* in a case where the image output is performed on both surfaces of the paper P.

The functions of the paper discharge unit 30 may include performing post-processing such as cutting and stapling (needle binding) on the paper bundle that is output from the image forming unit 10.

A drawer unit 18 (indicated by a dashed line in FIG. 1) as an example of a movable member is provided below the image forming unit 10 such that the drawer unit 18 can be pulled out with respect to an apparatus main body 11.

Accommodated by the drawer unit 18 are, for example, a paper supply unit 26 aligning the paper P and sending out the paper P toward the transfer device 15, a secondary transfer unit 52 secondarily transferring the toner image on an intermediate transfer belt 51 to the paper P, the paper transport device 16*a* transporting the paper P toward the fixing device 17, the paper transport device 16*b* transporting the paper P inverted for duplex printing toward the paper supply unit 26, and the fixing device 17. By the drawer unit 18 being pulled out to the operator side, paper jam handling is possible during the image formation.

(2) Harness Connection Structure

Figure 2:
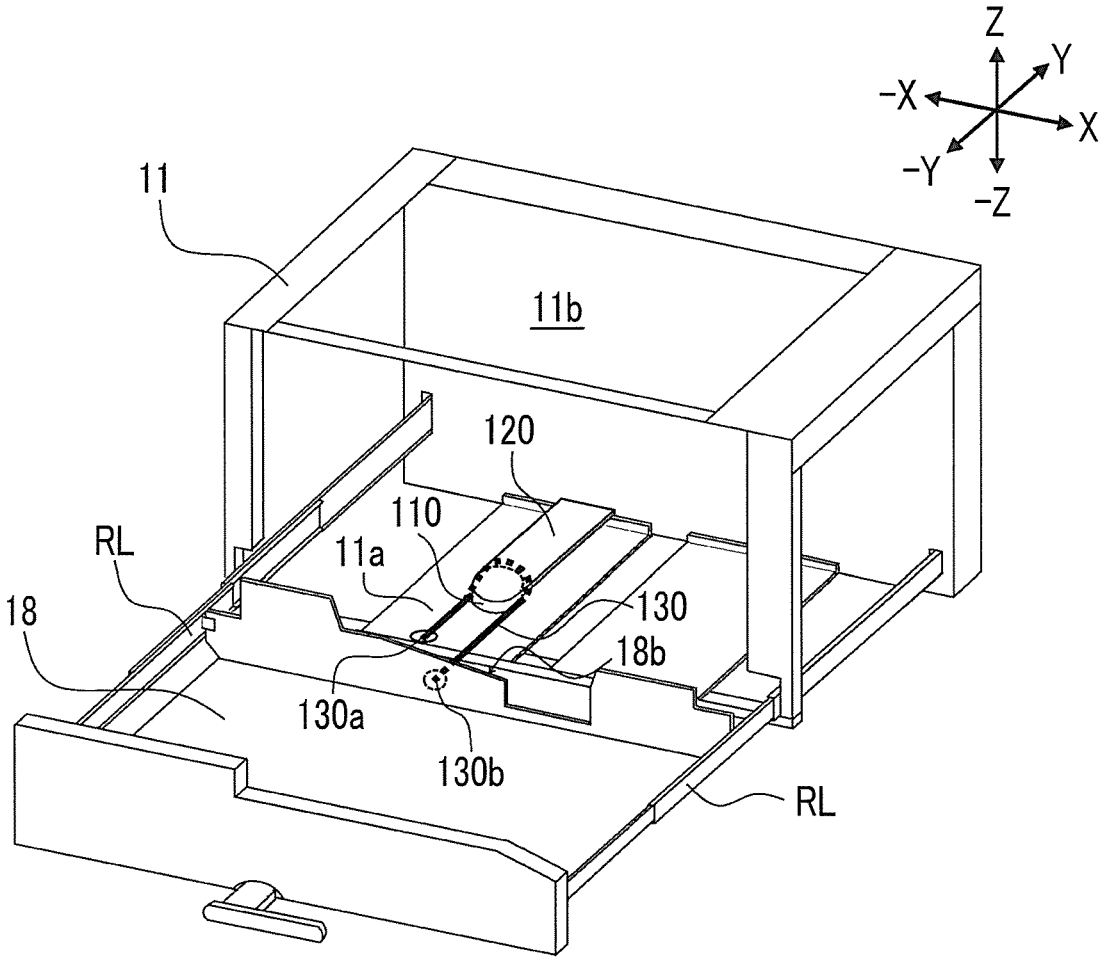
FIG. 2 is a perspective view illustrating a harness connection structure in a state where a drawer unit is pulled out.
Figure 3A:
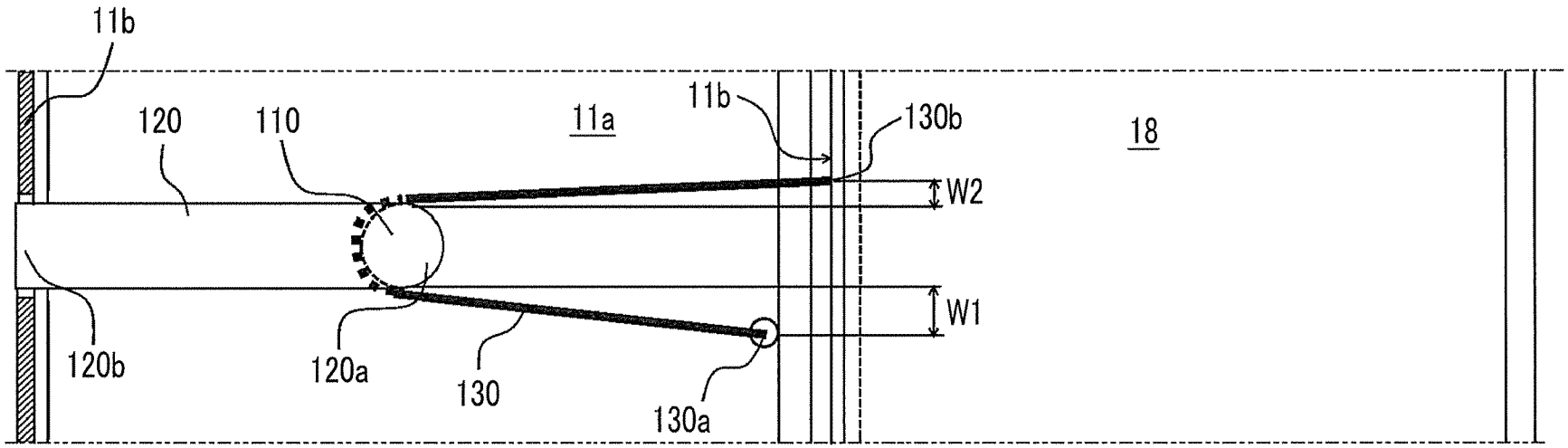
FIG. 3A is a schematic plan view illustrating a first suppressing portion and a second suppressing portion in a state where the drawer unit is pulled out.
Figure 3B:
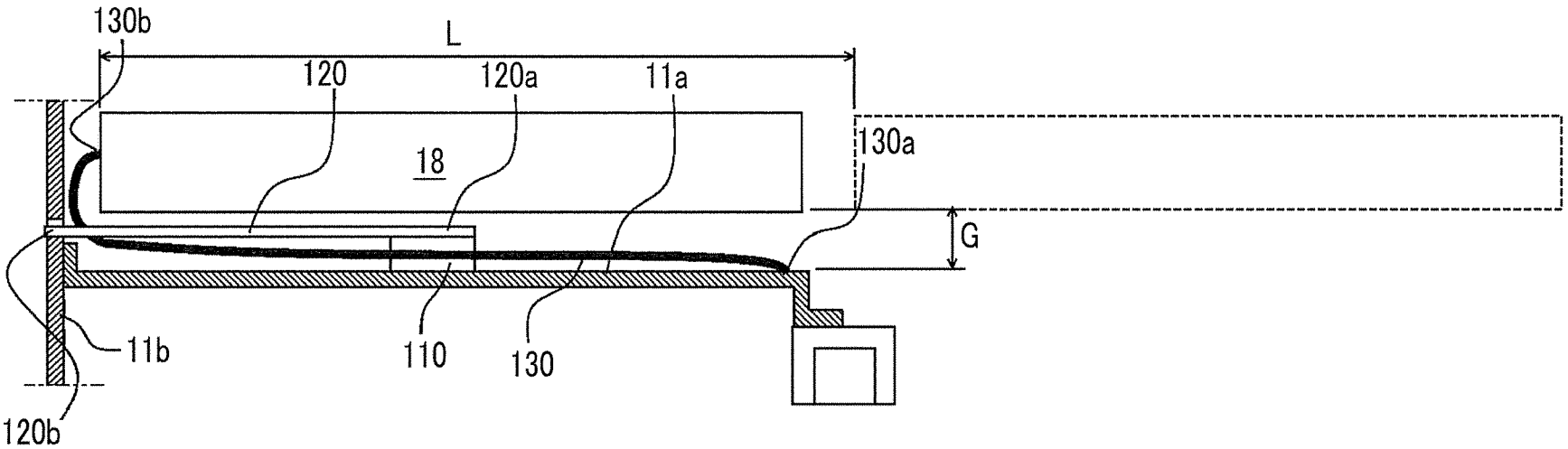
FIG. 3B is a schematic side view illustrating the first suppressing portion and the second suppressing portion in a state where the drawer unit is stored.
Figure 4A:
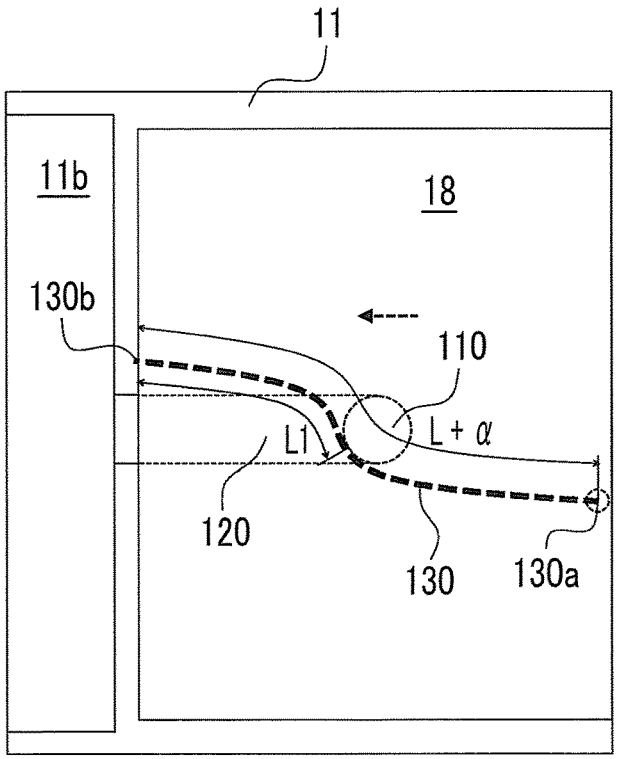
FIG. 4A is a schematic plan view illustrating the harness connection structure in a state where the drawer unit is stored.
Figure 4B:
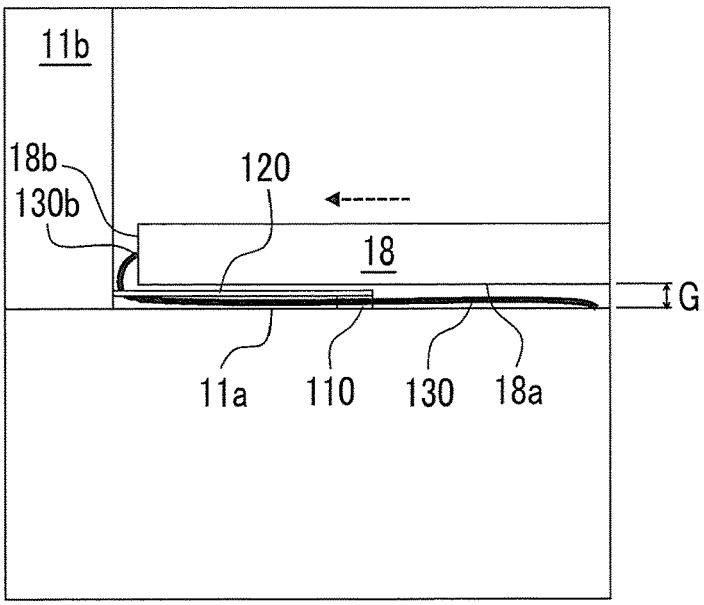
FIG. 4B is a schematic side view illustrating the harness connection structure in a state where the drawer unit is stored.
Figure 5A:
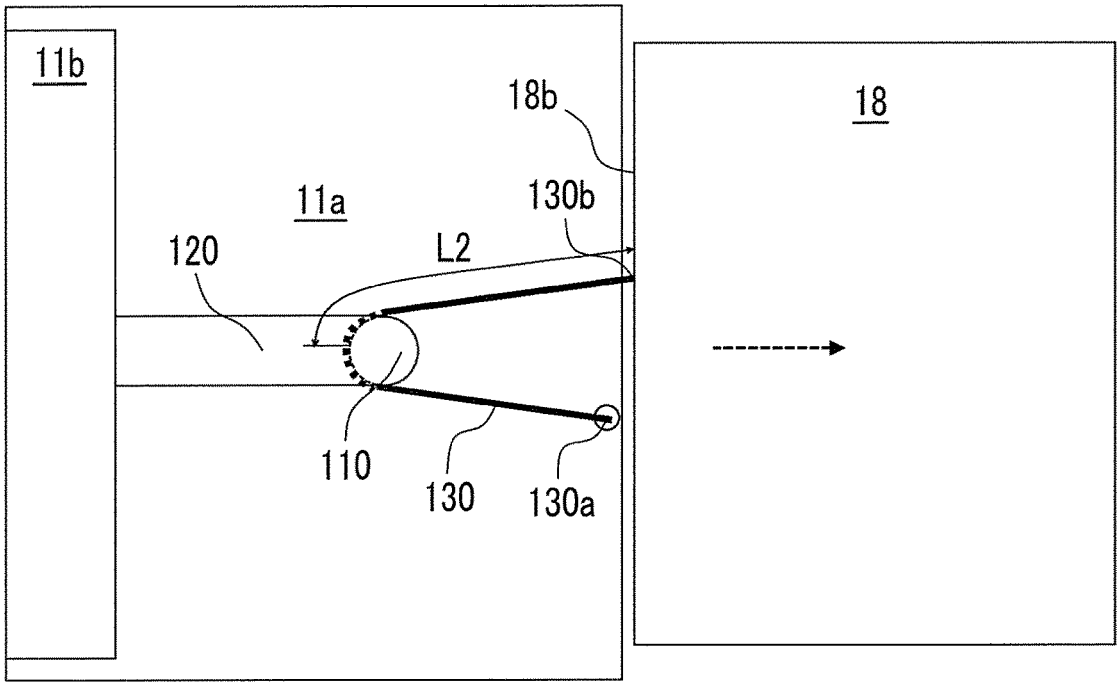
FIG. 5A is a schematic plan view illustrating the harness connection structure in a state where the drawer unit is pulled out.
Figure 5B:
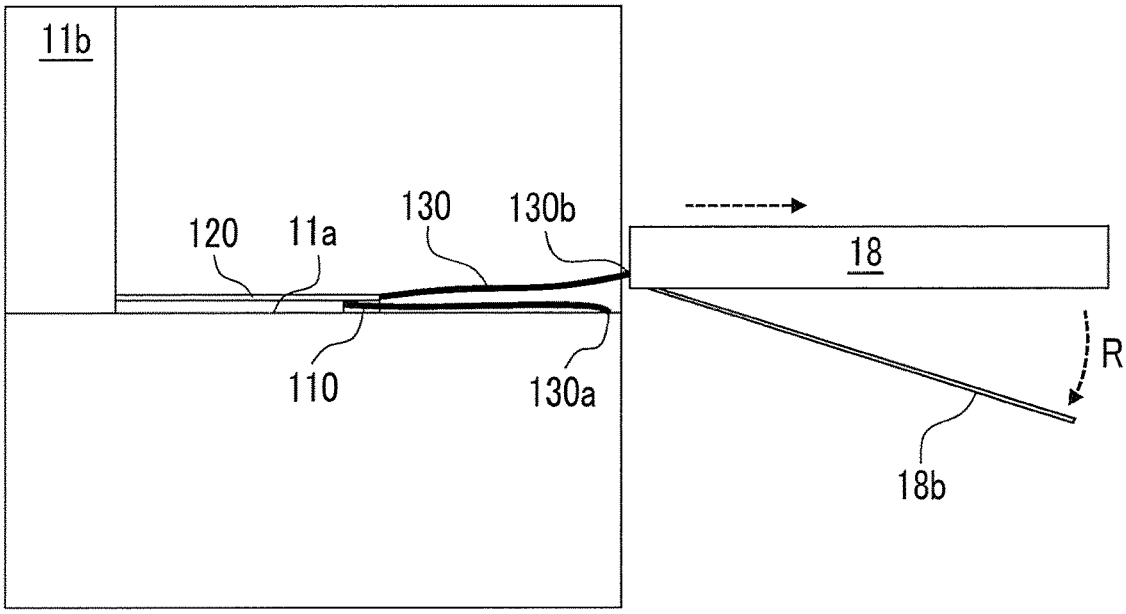
FIG. 5B is a schematic side view illustrating the harness connection structure in a state where the drawer unit is pulled out.

FIG. 2 is a perspective view illustrating a harness connection structure in a state where the drawer unit 18 is pulled out. FIG. 3A is a schematic plan view illustrating a first suppressing portion and a second suppressing portion in a state where the drawer unit 18 is pulled out. FIG. 3B is a schematic side view illustrating the first suppressing portion and the second suppressing portion in a state where the drawer unit 18 is stored. FIG. 4A is a schematic plan view illustrating the harness connection structure in a state where the drawer unit 18 is stored. FIG. 4B is a schematic side view illustrating the harness connection structure in a state where the drawer unit 18 is stored. FIG. 5A is a schematic plan view illustrating the harness connection structure in a state where the drawer unit 18 is pulled out. FIG. 5B is a schematic side view illustrating the harness connection structure in a state where the drawer unit 18 is pulled out.

Hereinafter, the configuration and operation of a harness connection structure 100 according to the present exemplary embodiment will be described with reference to the drawings.

(2.1) Configuration of Harness Connection Structure

The image forming apparatus 1 as an example of an electronic device is provided with the drawer unit 18 as an example of a movable member.

As illustrated in FIG. 2, the drawer unit 18 is provided such that the drawer unit 18 can be pulled out by a rail RL with respect to the apparatus main body 11. The drawer unit 18 is configured such that jam removal can be performed on the paper transport path that reaches the fixing device 17 (see FIG. 1) through the transfer device 15 and the paper transport device 16*a* from the paper supply unit 26 and regular maintenance and replacement can be performed on the secondary transfer unit 52 and the fixing device 17 by the drawer unit 18 being pulled out to the operator side.

In addition, the drawer unit 18 is configured such that the paper transport path of the paper transport device 16*b* for duplex printing can be opened (see FIG. 5B).

The drawer unit 18 uses AC power for the fixing device 17 and the like, and thus reliable grounding is required by law for operator protection from the risk of electric shock.

In the image forming apparatus 1 according to the present exemplary embodiment, a harness 130 provides wired connection between the drawer unit 18 and the apparatus main body 11 and reliable grounding is achieved as a result.

As illustrated in FIGS. 2 and 3, the harness 130 (indicated by a bold line in the drawings) provides the wired connection between the drawer unit 18 and the apparatus main body 11.

One end 130*a* of the harness 130 is fixed to the front side (foremost side in the present exemplary embodiment) of a bottom surface 11*a* in the pull-out direction of the drawer unit 18 (−Y direction). The bottom surface 11*a* is a surface of the apparatus main body 11 facing a surface of the drawer unit 18 with a gap. The other end 130*b* of the harness 130 is fixed to a surface 18*b* on the back side of the drawer unit 18 in the pull-out direction of the drawer unit 18 (−Y direction). The apparatus main body 11 and the drawer unit 18 are electrically connected as a result.

The thickness of the harness 130 and the like can be selected from American Wire Gauge (AWG) numbers in accordance with the AC power that is supplied to, for example, the fixing device 17 accommodated in the drawer unit 18.

Here, the front side refers to the pull-out direction side beyond the intermediate point in the depth direction of the bottom surface 11*a* of the apparatus main body 11.

Also included without limitation to the surface of the bottom surface 11*a* is the frame surface that vertically falls in front of the bottom surface 11*a*.

A first suppressing portion 110 is disposed on the bottom surface 11*a* of the apparatus main body 11 and suppresses a movement of the harness 130 to the pull-out side of the drawer unit 18 (in the −Y direction).

As illustrated in FIG. 2, the first suppressing portion 110 is columnar, the one end 130*a* of the harness 130 is fixed to the bottom surface 11*a* of the apparatus main body 11, the harness 130 is wound around the first suppressing portion 110, and the other end 130*b* of the harness 130 is fixed to the surface 18*b* on the back side of the drawer unit 18.

Here, the back side is the side that is opposite to the pull-out side of the drawer unit 18 (−Y direction) and refers to the side that is opposite to the pull-out side and beyond the intermediate point in the depth direction of the drawer unit 18.

The place where the other end 130*b* is fixed is not limited to the surface 18*b*. The place may correspond to the back side of a lower surface 18*a* of the drawer unit 18.

A second suppressing portion 120, which is disposed on the bottom surface 11*a* of the apparatus main body 11, is a plate-shaped member disposed so as to extend toward the pull-out direction of the drawer unit 18 from the upper part of the first suppressing portion 110.

The second suppressing portion 120 is fixed on the first suppressing portion 110 such that a front side 120*a* in the pull-out direction of the drawer unit 18 covers the first suppressing portion 110 and the other end side 120*b* is fixed by being inserted into a housing 11*b* on the back side of the apparatus main body 11.

The second suppressing portion 120 is disposed in a gap G between the bottom surface 11*a* of the apparatus main body 11 and the lower surface 18*a* of the drawer unit 18 as illustrated in FIG. 3B, and suppressed is a movement of the harness 130 toward the drawer unit 18 between the bottom surface 11*a* of the apparatus main body 11 and the lower surface 18*a* as a surface of the drawer unit 18.

As illustrated in FIGS. 2 and 3, the first suppressing portion 110 is provided at the intermediate position that bisects a movement range L (see FIG. 3B) in the pull-out direction of the drawer unit 18. The movement range L is between a storage position where the drawer unit 18 is stored in the apparatus main body 11 and a pull-out position where the drawer unit 18 is pulled out from the apparatus main body 11.

In a case where the position where the first suppressing portion 110 is disposed is viewed from the viewpoint of the length of the harness 130, the first suppressing portion 110 is provided at the intermediate position between the storage position and the pull-out position such that the length from the first suppressing portion 110 to a fixed position where the other end 130*b* of the harness 130 is fixed to the drawer unit 18 in the case of being positioned at the storage position where the drawer unit 18 is stored in the apparatus main body 11 and the length of the harness 130 from the first suppressing portion 110 to the fixed position in the case of being positioned at the pull-out position where the drawer unit 18 is pulled out from the apparatus main body 11 are substantially equal to each other.

As a result, it is possible to suppress the harness 130 coming into contact with another part without overhanging in a direction intersecting with the pull-out direction in the states where the drawer unit 18 is pulled out and stored.

As illustrated in FIG. 3A, the first suppressing portion 110 is disposed at a position where the position where the one end 130*a* of the harness 130 is fixed to the apparatus main body 11 and the position where the other end 130*b* of the harness 130 is fixed to the drawer unit 18 do not overlap with the position where the first suppressing portion 110 is disposed in a direction intersecting with the pull-out direction of the drawer unit 18 in plan view (see W1 and W2 in FIG. 3A).

More specifically, the first suppressing portion 110 is positioned between the position where the one end 130*a* of the harness 130 is fixed to the apparatus main body 11 and the position where the other end 130*b* of the harness 130 is fixed to the drawer unit 18 when viewed from the pull-out direction of the drawer unit 18.

As a result, it is possible to suppress damage to the harness 130 attributable to sharp bending resulting from the resilience unique to the harness 130 or twisting and distortion of the harness 130 and the pull-out direction side of the harness 130 can be reliably pressed by the first suppressing portion 110 when the drawer unit 18 is pulled out.

(2.2) Operation of Harness Connection Structure

As illustrated in FIG. 4, the one end 130*a* of the harness 130 is fixed to the foremost side of the bottom surface 11*a* of the apparatus main body 11 in the pull-out direction of the drawer unit 18 (−Y direction) and the other end 130*b* of the harness 130 is moved to the storage position together with the drawer unit 18 in a case where the drawer unit 18 is positioned at the storage position with respect to the apparatus main body 11.

In this state, the harness 130 has an extra length (L+□) between the one end 130*a* and the other end 130*b* in a state of being positioned at the storage position where the drawer unit 18 is stored in the apparatus main body 11.

As a result, the durability of the harness 130 can be improved.

In addition, the second suppressing portion 120 suppresses a movement of the harness 130 toward the drawer unit 18 and contact with the drawer unit 18 moving with a narrow gap with the harness 130 is prevented during a movement of the drawer unit 18 from the pull-out position to the storage position.

As illustrated in FIG. 5, the harness 130 is wound around the first suppressing portion 110 with the one end 130*a* fixed to the foremost side of the bottom surface 11*a* of the apparatus main body 11 in the pull-out direction of the drawer unit 18 (−Y direction) and the other end 130*b* is moved to the pull-out position together with the drawer unit 18 in a case where the drawer unit 18 is positioned at the pull-out position with respect to the apparatus main body 11.

An upward movement of the harness 130 is suppressed by the second suppressing portion 120 in the first suppressing portion 110 and the harness 130 is not released from the first suppressing portion 110 in a state of being wound around the first suppressing portion 110.

As for the drawer unit 18, it is possible to perform jam removal in the paper transport device 16*b* during duplex printing by opening the lower surface 18*b* at the pull-out position (see FIG. 5B).

In this manner, the length of the harness 130 from the position of the first suppressing portion 110 to the position of fixing to the drawer unit 18 remains substantially unchanged regardless of whether the drawer unit 18 is positioned at the storage position or the pull-out position (see L1 in FIG. 4A and L2 in FIG. 5A) and the harness 130 coming into contact with another part without overhanging in a direction intersecting with the pull-out direction (significantly swelling with slack) is suppressed in the states where the drawer unit 18 is pulled out and stored.

Modification Example 1

Figure 6:
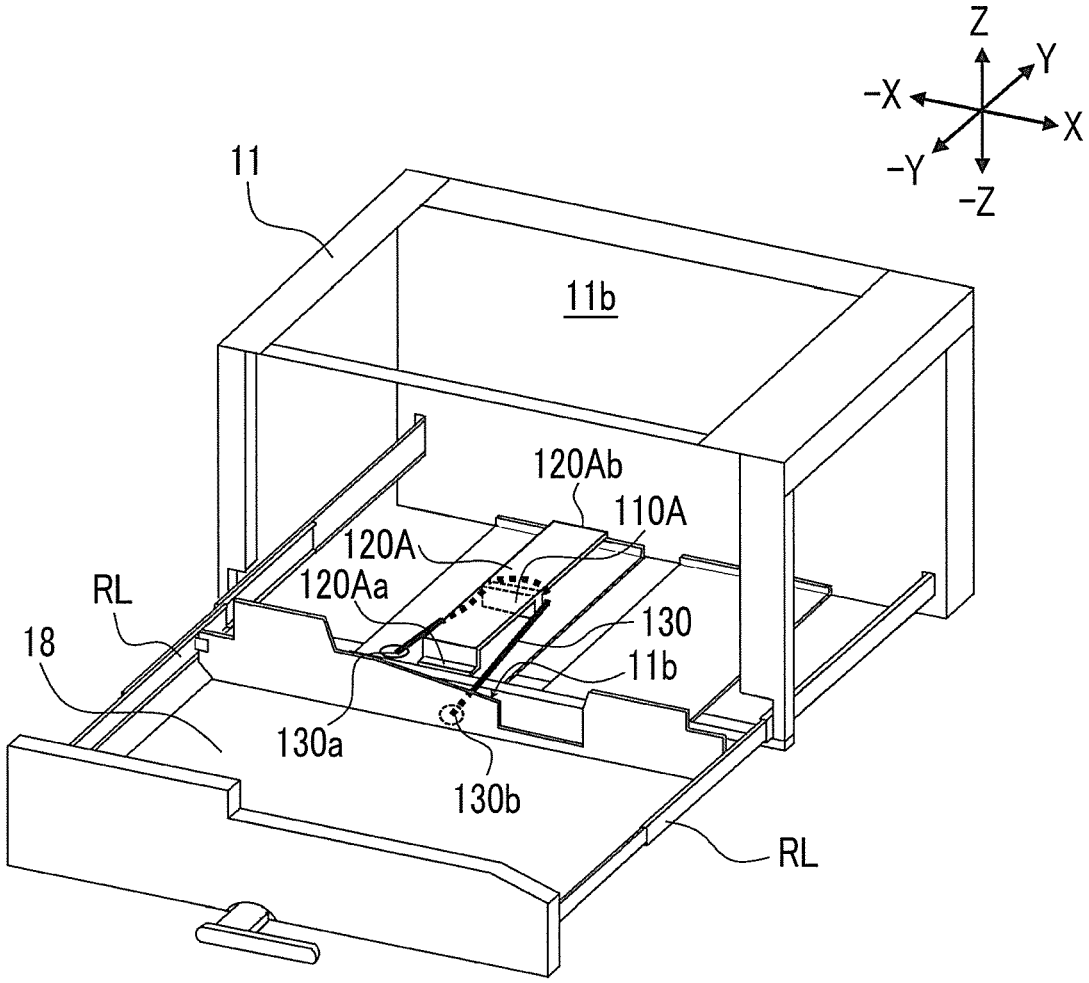
FIG. 6 is a perspective view illustrating a harness connection structure according to Modification Example 1 in a state where the drawer unit is pulled out.
Figure 7A:
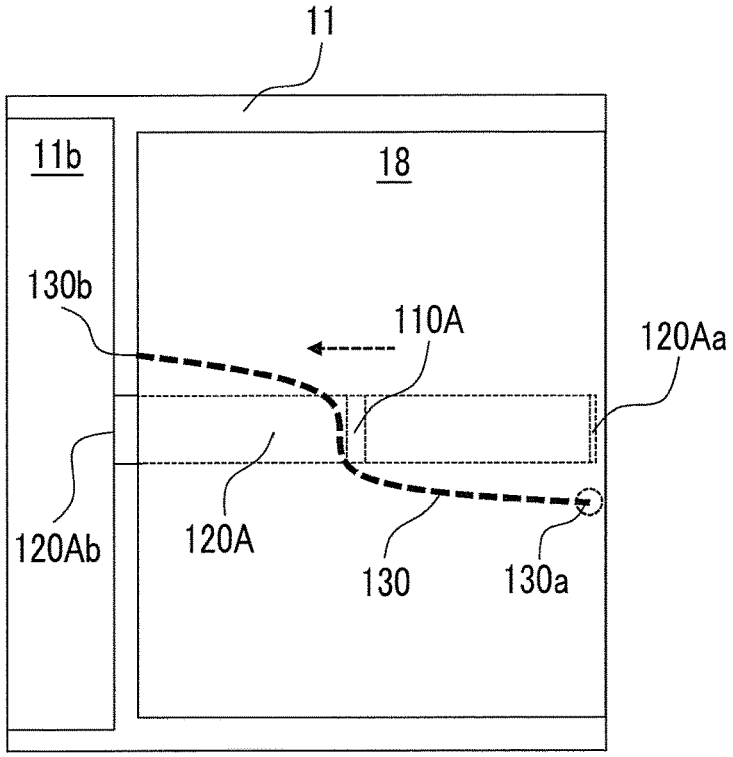
FIG. 7A is a schematic plan view illustrating the harness connection structure according to Modification Example 1 in a state where the drawer unit is stored.
Figure 7B:
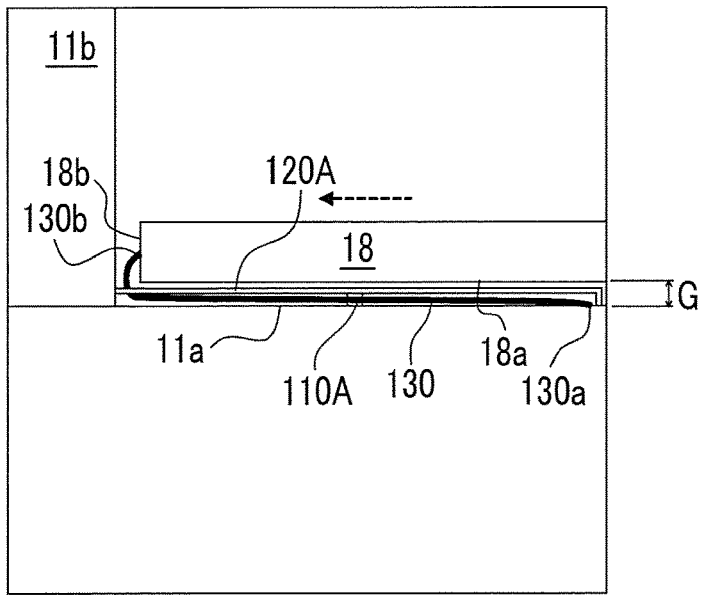
FIG. 7B is a schematic side view illustrating the harness connection structure according to Modification Example 1 in a state where the drawer unit is stored.
Figure 8A:
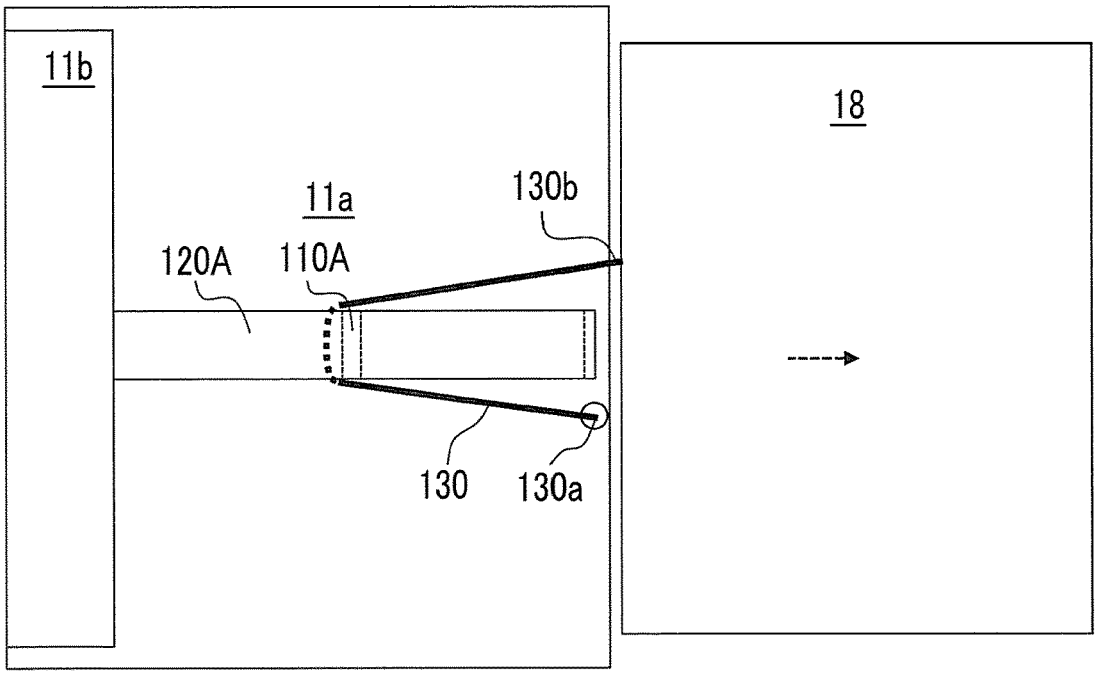
FIG. 8A is a schematic plan view illustrating the harness connection structure according to Modification Example 1 in a state where the drawer unit is pulled out.
Figure 8B:
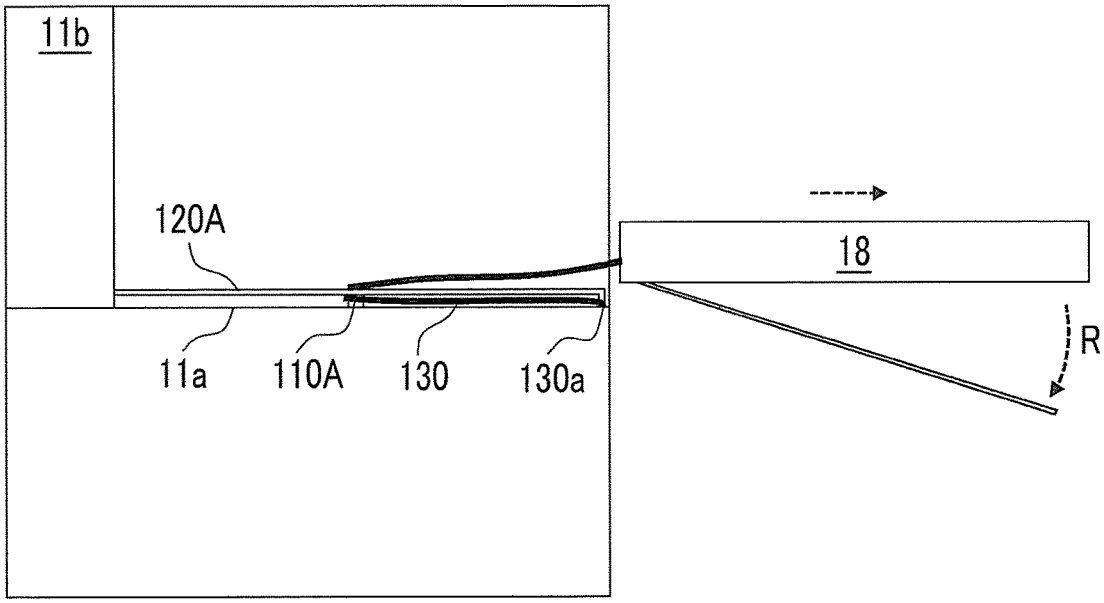
FIG. 8B is a schematic side view illustrating the harness connection structure according to Modification Example 1 in a state where the drawer unit is pulled out.

FIG. 6 is a perspective view illustrating a harness connection structure according to Modification Example 1 in a state where the drawer unit 18 is pulled out. FIG. 7A is a schematic plan view illustrating the harness connection structure according to Modification Example 1 in a state where the drawer unit 18 is stored. FIG. 7B is a schematic side view illustrating the harness connection structure according to Modification Example 1 in a state where the drawer unit 18 is stored. FIG. 8A is a schematic plan view illustrating the harness connection structure according to Modification Example 1 in a state where the drawer unit 18 is pulled out. FIG. 8B is a schematic side view illustrating the harness connection structure according to Modification Example 1 in a state where the drawer unit 18 is pulled out.

As illustrated in FIG. 6, a second suppressing portion 120A is provided on the bottom surface 11*a* of the apparatus main body 11 as a plate-shaped member extending to the storage position of the drawer unit 18 of the apparatus main body 11 in the pull-out direction of the drawer unit 18 (Y direction) with one end 120Aa fixed in one side end portion of the bottom surface 11*a*, which is a surface of the apparatus main body 11, in the pull-out direction of the drawer unit 18 and the other end 120Ab fixed to the other side end portion, which is on the side that is opposite to the side end portion in the pull-out direction.

As illustrated in FIG. 7B, the second suppressing portion 120A is disposed in the gap G between the bottom surface 11*a* of the apparatus main body 11 and the lower surface 18*b* of the drawer unit 18. The second suppressing portion 120A suppresses a movement of the harness 130 toward the drawer unit 18 between the lower surface 18*b* as a surface of the drawer unit 18 and the bottom surface 11*a* as a surface of the apparatus main body 11.

A first suppressing portion 110A is formed so as to protrude to a side facing the bottom surface 11*a* as a surface of the apparatus main body 11 of the second suppressing portion 120A so as to intersect with (be orthogonal to) the pull-out direction of the drawer unit 18 at the intermediate position bisecting the longitudinal direction (Y direction) of the second suppressing portion 120A in the pull-out direction of the drawer unit 18 (Y direction).

In the present modification example, the first suppressing portion 110A and the second suppressing portion 120A may be integrally formed.

In this case, the other end 120Ab of the second suppressing portion 120A is inserted into the housing 11*b* on the back side of the apparatus main body 11 and the end 120Aa of the second suppressing portion 120A is screw-fixed on the foremost side of the bottom surface 11*a* of the apparatus main body 11 in the pull-out direction of the drawer unit 18.

As a result, assemblability improvement is achieved as compared with the second suppressing portion 120 according to the exemplary embodiment described above.

As a result, it is possible to prevent contact between the harness 130 and the drawer unit 18 when the drawer unit 18 is moved to the storage position with a narrow gap maintained with respect to the apparatus main body 11 and it is possible to suppress the harness 130 coming into contact with another part without overhanging in a direction intersecting with the pull-out direction in the states where the drawer unit 18 is pulled out and stored.

Modification Example 2

Figure 9:
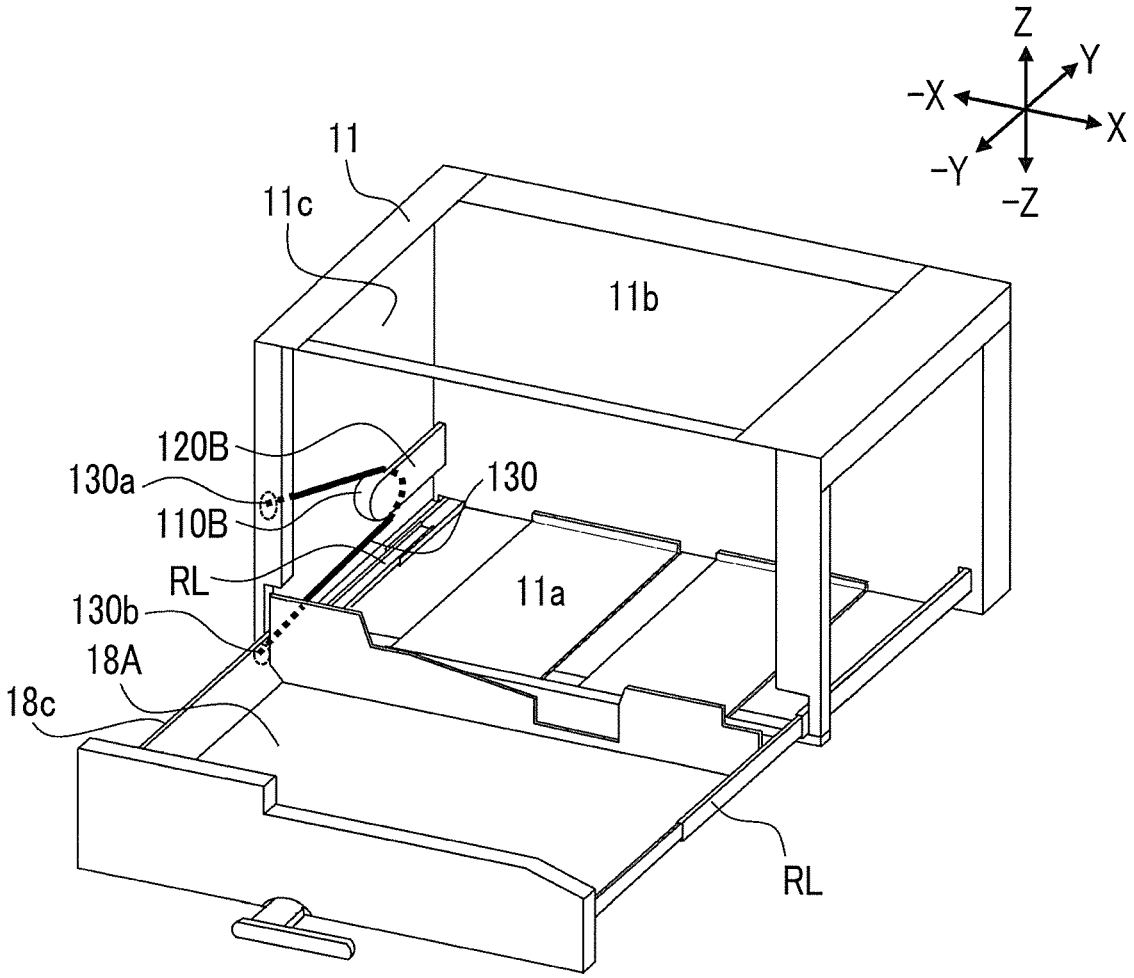
FIG. 9 is a perspective view illustrating a harness connection structure according to Modification Example 2 in a state where a drawer unit is pulled out.
Figure 10A:
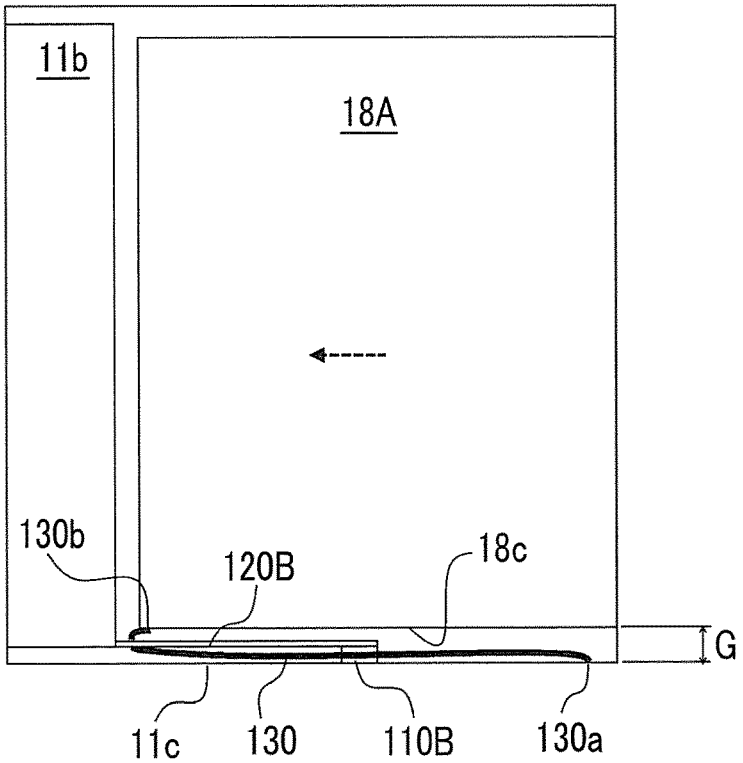
FIG. 10A is a schematic plan view illustrating the harness connection structure according to Modification Example 2 in a state where the drawer unit is stored.
Figure 10B:
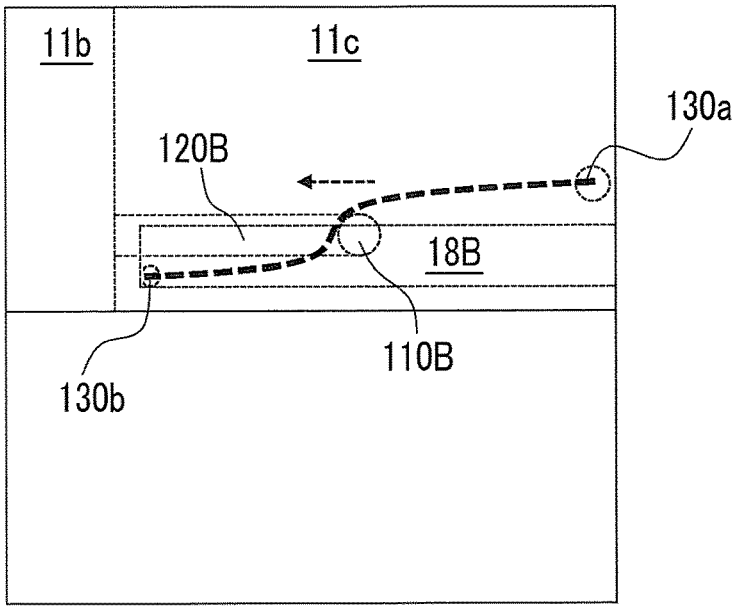
FIG. 10B is a schematic side view illustrating the harness connection structure according to Modification Example 2 in a state where the drawer unit is stored.
Figure 11A:
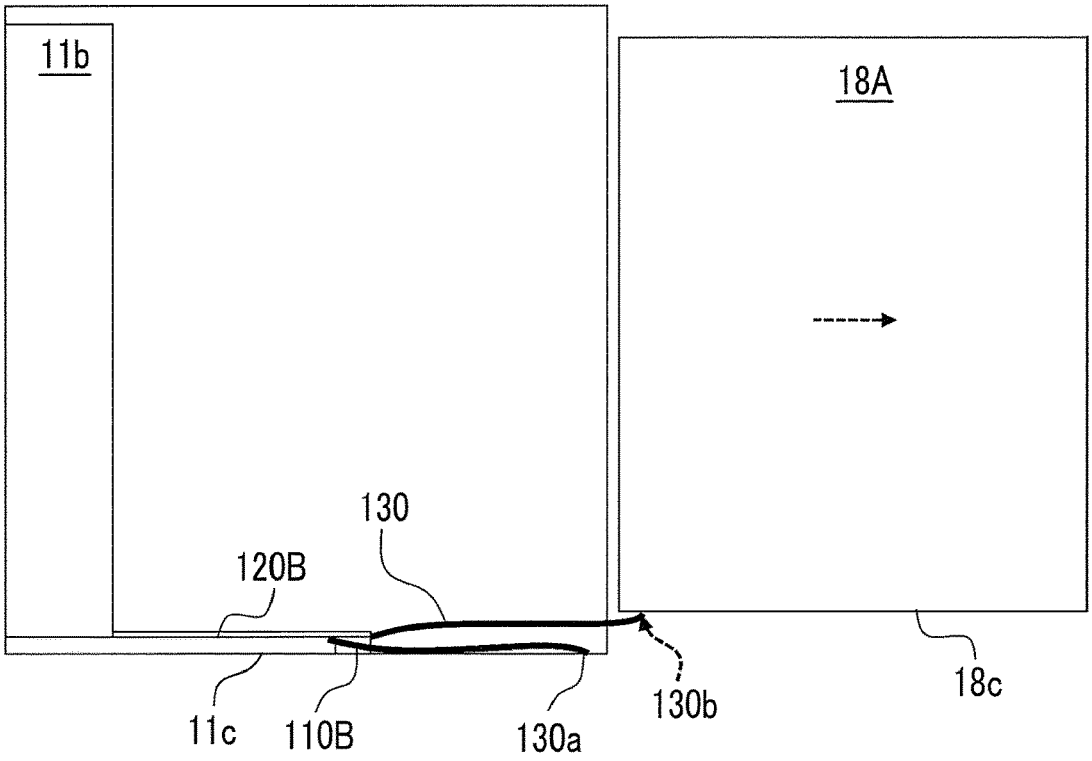
FIG. 11A is a schematic plan view illustrating the harness connection structure according to Modification Example 2 in a state where the drawer unit is pulled out.
Figure 11B:
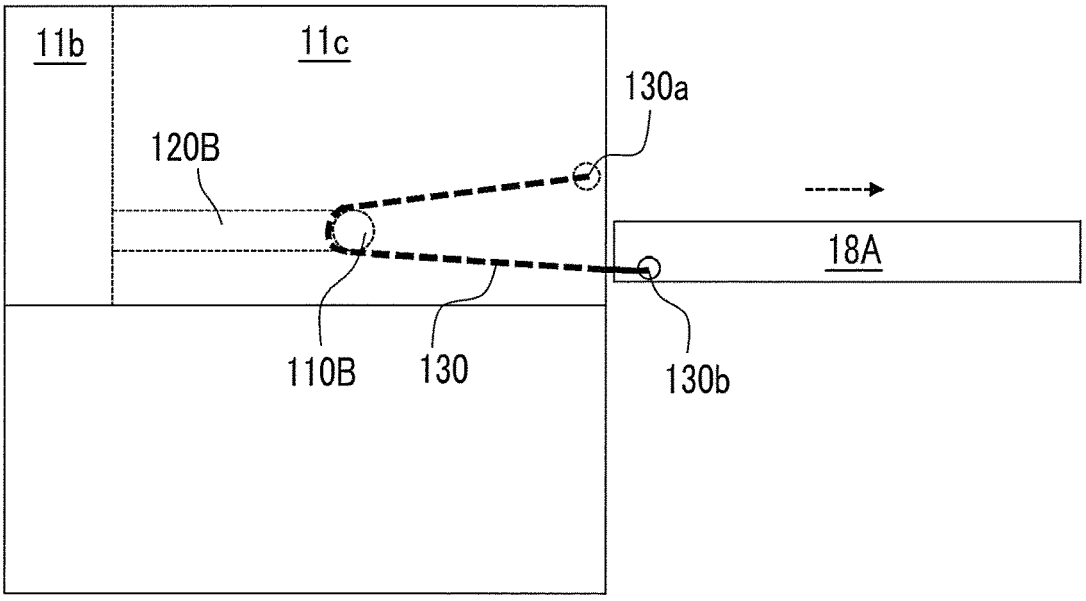
FIG. 11B is a schematic side view illustrating the harness connection structure according to Modification Example 2 in a state where the drawer unit is pulled out.

FIG. 9 is a perspective view illustrating a harness connection structure according to Modification Example 2 in a state where a drawer unit 18A is pulled out. FIG. 10A is a schematic plan view illustrating the harness connection structure in a state where the drawer unit 18A is stored. FIG. 10B is a schematic side view illustrating the harness connection structure in a state where the drawer unit 18A is stored. FIG. 11A is a schematic plan view illustrating the harness connection structure in a state where the drawer unit 18A is pulled out. FIG. 11B is a schematic side view illustrating the harness connection structure in a state where the drawer unit 18A is pulled out.

A first suppressing portion 110B is disposed on a left side surface 11*c* of the apparatus main body 11 and suppresses a movement of the harness 130 to the pull-out side of the drawer unit 18A (in the −Y direction).

As illustrated in FIG. 9, the first suppressing portion 110 is columnar, the one end 130*a* of the harness 130 is fixed to the left side surface 11*c* of the apparatus main body 11, the harness 130 is wound around first suppressing portion 110B, and the other end 130*b* of the harness 130 is fixed to the back side of a left side surface 18*c* of the drawer unit 18A.

A second suppressing portion 120B, which is disposed on the left side surface 11*c* of the apparatus main body 11, is a plate-shaped member disposed so as to extend toward the pull-out direction of the drawer unit 18A from the upper part of the first suppressing portion 110.

The second suppressing portion 120B is fixed on the first suppressing portion 110B so as to have a front side in the pull-out direction of the drawer unit 18A covering the first suppressing portion 110B from a side surface and the other end side is fixed by being inserted into the housing lib on the back side of the apparatus main body 11.

The second suppressing portion 120B is disposed in the gap G between the left side surface 11*c* of the apparatus main body 11 and the left side surface 18*c* of the drawer unit 18A as illustrated in FIG. 10A, and suppressed is a movement of the harness 130 toward the drawer unit 18 between the left side surface 18*c* as a surface of the drawer unit 18A and the left side surface 11*c* as a surface of the apparatus main body 11.

As a result, it is possible to prevent contact between the harness 130 and the drawer unit 18A when the drawer unit 18A is moved to the storage position with a narrow gap maintained with respect to the left side surface 11*c* of the apparatus main body 11 and it is possible to suppress the harness 130 coming into contact with another part without overhanging in a direction intersecting with the pull-out direction in the states where the drawer unit 18A is pulled out and stored.

Although the harness connection structure for the apparatus main body 11 and the drawer units 18 and 18A, which are examples of a movable member in which the fixing device 17 and the like are accommodated, has been described in the present exemplary embodiment, the movable member is not limited to the drawer units 18 and 18A. Alternatively, the movable member may be the paper trays 21 and 22 of the sheet feeding device 20 having a motor or the like as a sheet feeding mechanism drive source.

The electronic device to which the harness connection structure according to the present invention is applied is not limited to the image forming apparatus. Alternative examples include electronic devices such as image reading devices, image processing devices, and personal computers using electronic components using AC power.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A harness connection structure electrically connecting a main body and a movable member with a harness to each other, the movable member being provided such that the movable member can be pulled out with respect to the main body, the harness connection structure comprising:

a harness having one end fixed to a front side of one surface of the main body in a pull-out direction of the movable member, the one surface of the main body facing one surface of the movable member with a gap, and the other end fixed to a back side of the movable member in a pull-out direction of the movable member;

a first suppressing portion provided on the one surface of the main body and suppressing a movement of the harness to a pull-out side of the movable member; and a second suppressing portion suppressing a movement of the harness toward the movable member between the one surface of the movable member and the one surface of the main body.

2. The harness connection structure according to claim 1, wherein the first suppressing portion is provided at an intermediate position bisecting a movement range in a pull-out direction of the movable member, the movement range being between a storage position where the movable member is stored in the main body and a pull-out position where the movable member is pulled out from the main body.

3. The harness connection structure according to claim 2, wherein the second suppressing portion is provided on the one surface of the main body as a plate-shaped member having one end covering the first suppressing portion and the other end extending toward a storage position of the movable member in a pull-out direction of the movable member.

4. The harness connection structure according to claim 3, wherein the second suppressing portion is provided on the one surface of the main body as a plate-shaped member having one end fixed in one side end portion of the one surface of the main body in a pull-out direction of the movable member and the other end fixed to the other side end portion on a side opposite to the one side end portion in the pull-out direction and extending to a storage position of the movable member of the main body in a pull-out direction of the movable member.

5. The harness connection structure according to claim 2, wherein the second suppressing portion is provided on the one surface of the main body as a plate-shaped member having one end fixed in one side end portion of the one surface of the main body in a pull-out direction of the movable member and the other end fixed to the other side end portion on a side opposite to the one side end portion in the pull-out direction and extending to a storage position of the movable member of the main body in a pull-out direction of the movable member.

6. The harness connection structure according to claim 1, wherein the first suppressing portion is provided at an intermediate position between a storage position and a pull-out position such that a length of the harness from the first suppressing portion to a fixed position where one end of the harness is fixed to the movable member in a case of being positioned at the storage position where the movable member is stored in the main body and a length of the harness from the first suppressing portion to the fixed position in a case of being positioned at the pull-out position where the movable member is pulled out from the main body are substantially equal to each other.

7. The harness connection structure according to claim 6, wherein the second suppressing portion is provided on the one surface of the main body as a plate-shaped member having one end covering the first suppressing portion and the other end extending toward a storage position of the movable member in a pull-out direction of the movable member.

8. The harness connection structure according to claim 7, wherein the second suppressing portion is provided on the one surface of the main body as a plate-shaped member having one end fixed in one side end portion of the one surface of the main body in a pull-out direction of the movable member and the other end fixed to the other side end portion on a side opposite to the one side end portion in the pull-out direction and extending to a storage position of the movable member of the main body in a pull-out direction of the movable member.

9. The harness connection structure according to claim 6, wherein the second suppressing portion is provided on the one surface of the main body as a plate-shaped member having one end fixed in one side end portion of the one surface of the main body in a pull-out direction of the movable member and the other end fixed to the other side end portion on a side opposite to the one side end portion in the pull-out direction and extending to a storage position of the movable member of the main body in a pull-out direction of the movable member.

10. The harness connection structure according to claim 1, wherein the second suppressing portion is provided on the one surface of the main body as a plate-shaped member having one end covering the first suppressing portion and the other end extending toward a storage position of the movable member in a pull-out direction of the movable member.

11. The harness connection structure according to claim 10, wherein the second suppressing portion is provided on the one surface of the main body as a plate-shaped member having one end fixed in one side end portion of the one surface of the main body in a pull-out direction of the movable member and the other end fixed to the other side end portion on a side opposite to the one side end portion in the pull-out direction and extending to a storage position of the movable member of the main body in a pull-out direction of the movable member.

12. The harness connection structure according to claim 1, wherein the second suppressing portion is provided on the one surface of the main body as a plate-shaped member having one end fixed in one side end portion of the one surface of the main body in a pull-out direction of the movable member and the other end fixed to the other side end portion on a side opposite to the one side end portion in the pull-out direction and extending to a storage position of the movable member of the main body in a pull-out direction of the movable member.

13. The harness connection structure according to claim 12, wherein the first suppressing portion is formed so as to protrude to a side facing the one surface of the main body side of the second suppressing portion so as to intersect with a pull-out direction of the movable member at an intermediate position bisecting a longitudinal direction of the second suppressing portion in a pull-out direction of the movable member.

14. The harness connection structure according to claim 13, wherein the first suppressing portion is provided at an intermediate position between a storage position and a pull-out position such that a length of the harness from the first suppressing portion to a fixed position where one end of the harness is fixed to the movable member in a case of being positioned at the storage position where the movable member is stored in the main body and a length from the first suppressing portion to the fixed position in a case of being positioned at the pull-out position where the movable member is pulled out from the main body are substantially equal to each other.

15. The harness connection structure according to claim 1, wherein a position where one end of the harness is fixed to the main body and a position where the other end of the harness is fixed to the movable member are disposed at a position not overlapping with a position where the first suppressing portion is disposed in a direction intersecting with a pull-out direction of the movable member.

16. The harness connection structure according to claim 15, wherein in the non-overlapping position, the first suppressing portion is positioned between a position where one end of the harness is fixed to the main body and a position where the other end of the harness is fixed to the movable member when viewed from a pull-out direction of the movable member.

17. The harness connection structure according to claim 1, wherein the harness has an extra length between the one end and the other end in a state of being positioned at a storage position where the movable member is stored in the main body.

18. The harness connection structure according to claim 1, wherein the one surface of the main body is a surface facing a lower portion of the movable member with a gap.

19. The harness connection structure according to claim 1, wherein the one surface of the main body is a surface facing a side portion of the movable member with a gap.

20. An electronic device comprising:

the harness connection structure according to claim 1; and a movable member capable of being pulled out with respect to a main body and driven by an alternating current.

* * * * *